US007163404B2

(12) United States Patent
Linssen et al.

(10) Patent No.: US 7,163,404 B2
(45) Date of Patent: Jan. 16, 2007

(54) DEVICE FOR PLACING A LAMP IN A REFLECTOR

(75) Inventors: Petrus Johannes Antonius Linssen, Eindhoven (NL); Antonius Nicolaas Theelen, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 10/523,043

(22) PCT Filed: Jul. 18, 2003

(86) PCT No.: PCT/IB03/03272

§ 371 (c)(1),
(2), (4) Date: Feb. 2, 2005

(87) PCT Pub. No.: WO2004/015331

PCT Pub. Date: Feb. 19, 2004

(65) Prior Publication Data

US 2006/0040516 A1 Feb. 23, 2006

(30) Foreign Application Priority Data

Aug. 7, 2002 (EP) ..... 02078263

(51) Int. Cl.
*H01R 12/00* (2006.01)
*H01R 24/00* (2006.01)

(52) U.S. Cl. ..... 439/56; 439/699.2

(58) Field of Classification Search ..... 439/56, 439/699.2, 581, 582, 57, 617; 362/486, 266
See application file for complete search history.

(56) References Cited

U.S. PATENT DOCUMENTS

| | | | | | |
|---|---|---|---|---|---|
| 4,353,109 | A | * | 10/1982 | Weber | 362/13 |
| 4,547,840 | A | * | 10/1985 | Tinder | 362/646 |
| 5,264,998 | A | * | 11/1993 | Bax | 362/646 |
| 5,288,249 | A | * | 2/1994 | Fitzgerald | 439/612 |
| 5,389,010 | A | * | 2/1995 | Takano et al. | 439/565 |
| 6,039,579 | A | * | 3/2000 | Paul et al. | 439/56 |
| 6,139,334 | A | * | 10/2000 | Forish et al. | 439/56 |
| 6,162,096 | A | * | 12/2000 | Klaus | 439/617 |

FOREIGN PATENT DOCUMENTS

DE 19752979 6/1999

* cited by examiner

*Primary Examiner*—Hien Vu

(57) ABSTRACT

In a device for placing a lamp in a reflector, a socket for holding a lamp is provided with a main body part to be brought into contact with the a reflector. The lamp is held with a resilient annular spring secured to the main body part, and with two upright arms provided with clicks, while a back plate is provided with pressure points. When securing the back plate to the reflector, the reference plane is brought into contact with the reflector, and the pressure points, when in contact with the clicks of the socket, displace the clicks in the direction of the reflector over a distance Δx so as to put the annular spring under tension. The distance Δx is such that the annular spring presses the reference plane towards the reflector with a force of at least 5N.

15 Claims, 3 Drawing Sheets

DEVICE FOR PLACING A LAMP IN A REFLECTOR

The invention relates to a device for placing a lamp in a reflector, said device comprising: a socket for holding a lamp and a back plate to be secured to the reflector.

DE-A1-197 52 979 describes the insertion of a lamp into a reflector at the rear of the reflector. Although this device is used in automobiles, it has the disadvantage, for example, that the socket holding the lamp is not pressed with a sufficiently, strong force against the reflector to withstand strong vibrations and shocks, so that the lamp cannot always be safely located in the correct position.

The invention solves this problem and further provides a device of a different construction principle that makes use of a back plate for holding a socket safely pressed against a reflector, preferably a reflector of an automobile.

According to the invention, there is provided a device for placing a lamp in a reflector, said device comprising:

a socket for holding a lamp and a back plate to be secured to the reflector, characterized in that said socket is provided with a main body part, with a reference plane brought into contact with the reflector surface, with means for holding the lamp at one side of the reference plane, with a resilient annular spring secured to the main body part at the opposite side of the reference plane, and with two upright arms provided with said back plate being provided with pressure points, wherein, when securing the back plate to the reflector, the reference plane is brought into contact with said reflector surface, and the pressure points, when in contact with the clicks of the socket, displace the clicks in the direction of the reflector over a distance $\Delta x$ so as to put the annular spring under tension, said distance $\Delta x$ being such that the annular spring presses the reference plane towards said reflector surface with a force of at least 5 N, preferably with a force of at least 10 N.

According to a preferred embodiment, the clicks are displaced by the pressure points over a distance ranging from 0.5 mm to 2 mm, preferably 0.8 mm to 1.3 mm. This ensures a desired safe positioning of the lamp in the reflector.

Advantageously, the main body part is provided with two electrically conducting female terminals and the back plate is provided with two mating electrically conducting male terminals such that, when the back plate is moved towards the socket, the male terminal is inserted with friction into the female terminal, to hold the back plate and socket together and to adjust the pressure points with respect to the clicks.

According to a further preferred embodiment, the socket is formed as an integral part from a synthetic resin, preferably polyamide. This socket has good resilience and can withstand the relatively high temperatures generated by the lamp.

Preferably, the back plate is made of an electrically insulating material and is provided with one or more printed circuit(s) connected to the male terminals.

According to a further preferred embodiment, the back plate comprises more than one set of pressure points to bring an equal number of sockets into contact with a reflector unit provided with a number of reflectors. For example, a back light, a brake light, and a direction indicator light may thus be placed easily and safely in the reflector unit.

The invention further relates to a socket for use in said device and to a back plate for use in the device.

A non-limiting but preferred embodiment of the invention will now be described with reference to the drawing, in which.

Figure 1:
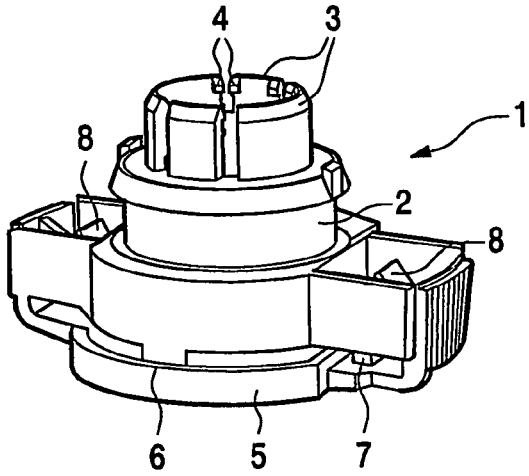
FIG. 1 is a socket to be secured to a reflector.

FIG. 1 is a schematic perspective view of a lamp mounting socket or cap 1 for a light source, especially a halogen lamp, for example for use as a tail lamp in an automobile. The socket or cap 1 has a main body part 2. This main body part 2 is provided with upright resilient tongues 3 with small conical protuberances or catches 4 to securely hold a light source. At the lowerside of the main body part 2, an annular spring 5 is secured in two diametrically opposed locations indicated with the reference numeral 6 (only one is shown). The annular spring 5 is provided with upright arms 7 at two diametrically opposed sides. These upright arms 7 are substantially 90° offset with respect to the securing locations 6 of the annular spring 5. The arms 7 provided with catches or clicks 8 are at their ends.

The socket or cap 1 is formed as one single part from a thermoplastic resin, preferably polyamide. This material has a sufficient resilience and can withstand the relatively high temperatures that are generated by the lamp in use.

A socket or cap 1 of this kind is intended to be used in a reflector of an automobile, for example as a socket for a tail light, a braking light, or a direction indicator light. After a lamp (not shown in this Figure), for example a recently developed high-performance halogen lamp of small dimension but with a high light intensity, has been inserted into the socket or cap 1 such that the catches 4 securely hold the lamp, the cap is to be mounted on a reflector. For this purpose the reflector is provided with a mounting opening into which the circular main body part 2 of the cap 1 can be inserted. The reflector may normally further be provided with associated wall parts, for example each with an opening. Each socket click 8 can be clicked into such an opening by pressing the resilient annular spring 5 upwards. The resilience of the spring activates a pressure force that withstands vibrations and shocks and safely retains the cap 1 in the reflector. A retention of this kind is known to those skilled in the art.

To seal the cap in the reflector against humidity or dust, the main body part 2 may be provided at its circumference with an annular groove (not shown) into which a sealing ring can be inserted.

Sockets of this kind normally have electrical contacts in the hollow inner part of the main body 2 for connection to a plug or connector, to provide the electrical energy for the lamp. At the rear of an automobile, the reflector may have a lamp for the backing light, a lamp for the brake light, and a lamp for the direction indicator, so that for each lamp a socket or cap 1 has to be clicked into the relevant part of the reflector and the plug or connector has to be inserted into the socket. The electrical wires of the connector normally lead to a printed circuit board provided with the required electrical circuit(s).

A large number of set makers prefer the mounting of the sockets or caps 1 in a reflector with the use of a "back plate", instead of caps clicking with their clicks 8 into relevant click openings of the reflector. This may further advantageously prevent the use of said plug or connector and makes it unnecessary to secure the electrical leads of the plug(s) to, for example, a separately positioned circuit board.

Figure 2:
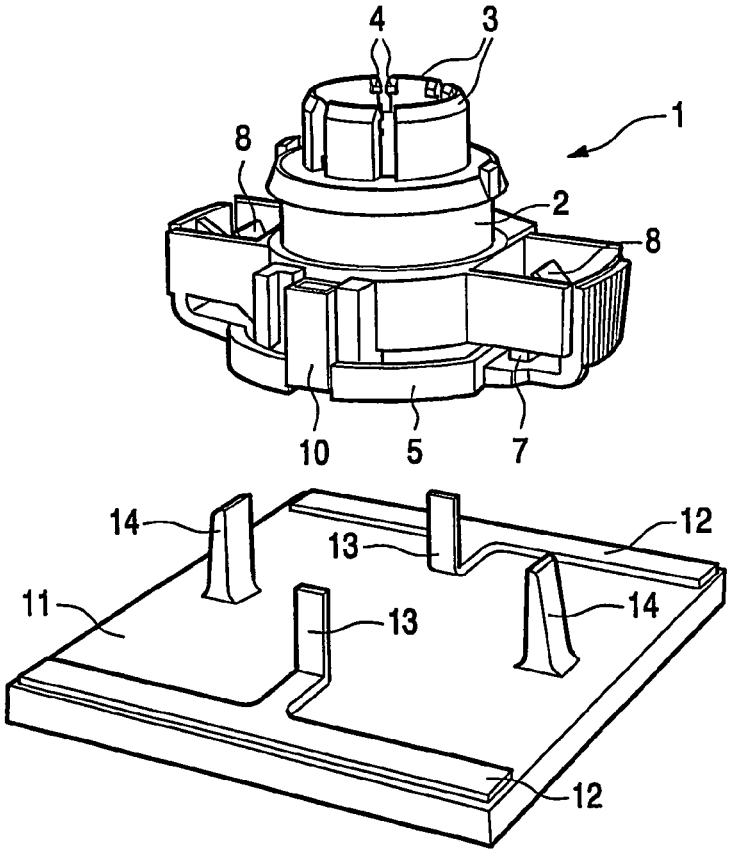
FIG. 2 shows a back plate with socket according to the invention.

FIG. 2 schematically illustrates an example of the possibility of mounting the cap 1 with the help of a schematically shown back plate 11. The solution according to the invention is such that the construction of the cap can essentially be equivalent to that of the cap according to FIG. 1, only the electrical connections need a minor change.

In FIG. 2, the cap 1 is shown with the main body part 2, the tongues 3 provided with the small conical catches 4 to hold a lamp tightly, the resilient annular spring 5, and the upright arms 7 with catches or clicks 8. In the embodiment shown, the electrical connection to an electrical power supply is formed by electrically conducting hollow terminals 10 of rectangular cross section (only one is shown). These terminals or female contacts 10 are secured to the elements to connect the annular spring 5 to the main body part 2, for example as indicated by the reference numeral 6 in FIG. 1. The electrical connection of the hollow terminals to the lamp to be placed in the cap 1 may be of any suitable kind within the knowledge of those skilled in the art and is not relevant to the present invention.

FIG. 2 schematically shows a back plate 11 (or mounting panel with printed circuit). The back plate 11 consists of an electrically non-conducting material and is provided with a printed circuit of which only leads 12 are diagrammatically shown in this Figure. The back plate 11 is provided with electrically conducting upright back plate terminals or male contacts 13. These male contacts 13 of the back plate 11 can be inserted into the female contacts 10 of the cap 1 when the back plate 11 is brought into contact with the cap 1. Frictional contact between the terminals 13 and the hollow terminals 10 ensures that the back plate 11 and cap 1 are held together before this combination is secured to the reflector of, for example a rear light of an automobile while at the same time providing the necessary electrical contact.

According to the invention, the back plate 11 is provided with pressure points 14 that, when the back plate 11 and the cap 1 are moved together, are brought into contact with the clicks 8 of the upright arms 7 of the cap 1.

Figure 3:
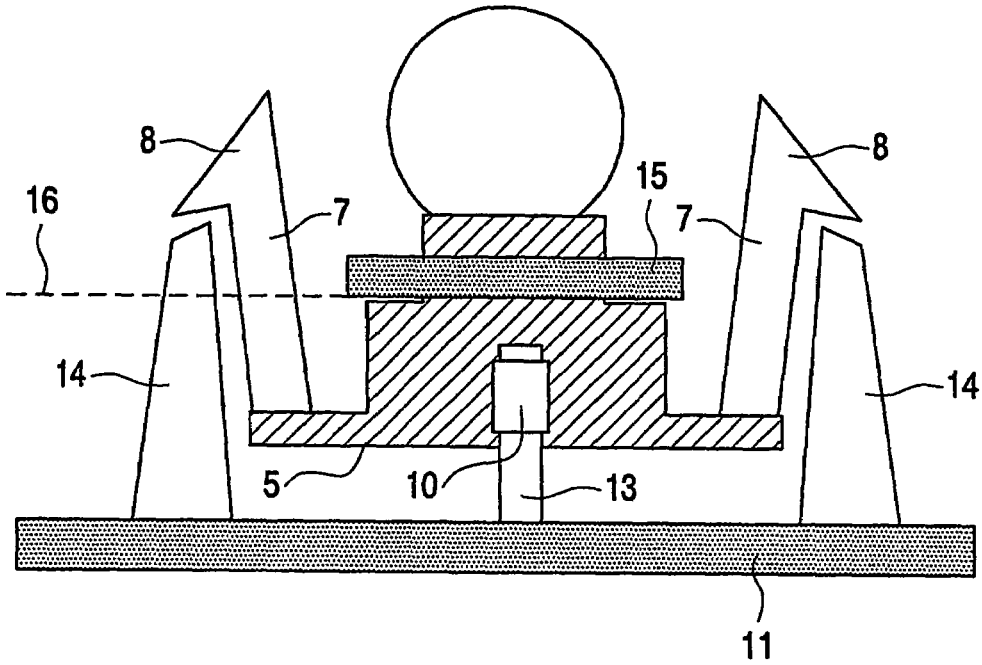
FIG. 3 is a very schematic view of the combination of back plate and socket.

FIG. 3 is a very schematic view in which only the parts of FIGS. 1 and 2 essential to the invention are shown, to disclose the principle of the invention. A cap 1 as shown in FIGS. 1 and 2 will not be clicked with the clicks 8 into openings of associated parts of a reflector, as mentioned with reference to FIG. 1, but according to the invention use is made of a back plate 11 with pressure points that can come into contact with the clicks 8 of the arms 7. When securing the back plate 11 to the reflector, as will be described with reference to FIG. 4, the pressure points 14 displace the clicks over a small distance and thus exercise a force on the annular spring 5, due to which the cap 1 will brought into the correct position in the reflector and can further withstand vibrations and shocks so that it will be securely be held in place. (Only a part 15 of the reflector is shown, said part being provided with an opening 18 (see FIG. 4*c*) into which the upper portion of the main body part 2 is inserted; a lower portion of the main body part 2 is in contact with the reflector 15 at the position of a reference plane 16).

FIGS. 4*a*–*d* show the principle of how the combination of cap 1 and back plate 11 is used to secure the cap 1 safely in the reflector 17.

Figure 4A:
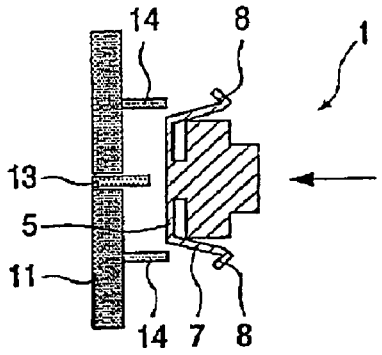
FIGS. 4*a*–4*d* show several steps in the process of securing the socket to a reflector.

In FIG. 4*a*, the cap 1 and back plate are shown in the still separated position in which the cap1 is placed above the back plate 11. Back plate 11 and cap 1 are brought into the mutually correct positions in that the male terminals 13 are inserted into the female terminals 10.

Figure 4B:
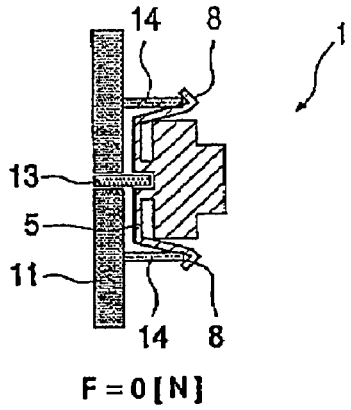

FIG. 4*b* shows the position in which the cap and back plate are held together due to the friction between the male terminal 13 that is inserted in the female terminal. The pressure points 14 are in contact with the clicks 8 but do not exercise a force on the clicks. The annular spring 5 is thus free of tension.

Figure 4C:
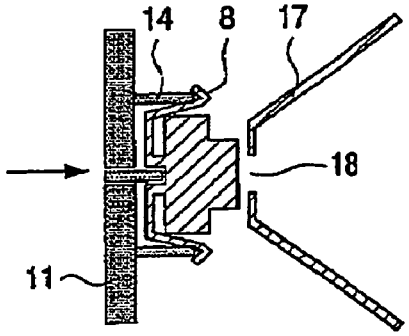

In FIG. 4*c*, the reflector 17 is schematically shown. The reflector has an opening 18 into which the upper part of the cap can be inserted (as described with reference to FIG. 3).

Figure 4D:
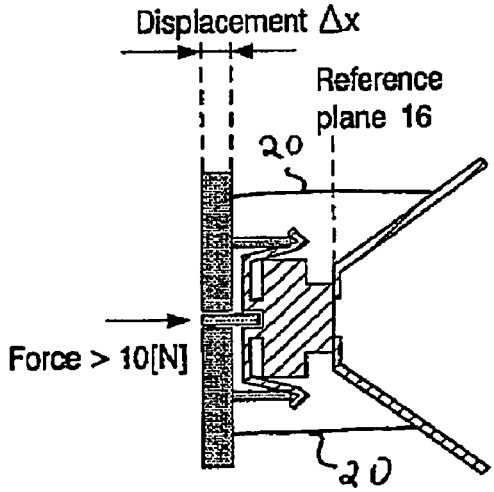

FIG. 4*d* shows how the combination of cap and back plate is mounted on the reflector 17 (see also FIG. 3). First the reference plane 16 comes into contact with the reflector. Then the back plate will be secured to the reflector. This may take place, for example, by securing the back plate to the reflector with the aid of screws 20 or in any other suitable way. The reference plane 16 is brought into contact with the reflector surface, and the pressure points 14, when in contact with the clicks 8, displace the clicks in the direction of the reflector over a distance $\Delta x$ so as to put the annular spring 5 under tension. The distance of displacement of the clicks 8 with respect to the main body part 2 of the socket is such that the annular spring presses the reference plane 16 against said reflector surface. This compression force is at least 5 N and preferably at least 10 N. In this way the socket is safely held to the reflector and can withstand vibrations and shocks while the lamp is placed in the desired position. Preferably the distance $\Delta x$ ranges from 0.5 mm to 2 mm, more preferably from 0.8 mm to 1.3 mm.

The back plate may have more than one, set of pressure points (14) to bring an equal number of sockets into contact with a reflector unit provided with a number of reflectors. This may be chosen when, for example, a back light, a braking light and/or a direction indicator light has to be placed in the reflector unit in the rear part of an automobile.

It will be understood that the description and drawing are merely a non-limiting example of the present invention and that changes and modifications may be included within the scope of the appended claims.

The invention claimed is:

1. A device for placing a lamp in a reflector, said device comprising:

a socket for holding a lamp and having printed circuits connected to respective male terminals thereon and having pressure points extending upwardly therefrom wherein said socket comprises:

a main body part to be brought into contact with the a reflector surface, means for holding the lamp, a resilient annular spring secured to the main body part, and two upright arms provided with clicks, wherein the pressure points, when in contact with the clicks of the socket, displace the clicks in the direction of the reflector over a distance $\Delta x$ so as to put the annular spring under tension, said distance $\Delta x$ being such that the annular spring presses the main body part towards said reflector with a force of at least 5 N.

2. The device according to claim 1, wherein the clicks are displaced by the pressure points over a distance ranging from 0.5 mm up to 2 mm.

3. The device according to claim 1, wherein the main body part includes two electrically conducting female terminals, and the back plate includes two mating electrically conducting male terminals such that, when the back plate is moved towards the socket, the male terminal is inserted with friction into the female terminal so as to hold the back plate and socket together and to position the pressure points with respect to the clicks.

4. The device according to claim 1, wherein the socket is formed as an integral part from a synthetic resin.

5. The device according to claim 1, wherein the back plate is made from an electrically insulating material and includes one or more printed circuit(s) connected.

6. The device according to claim 1, wherein the back plate comprises more than one set of pressure points to bring an equal number of sockets into contact with a reflector unit provided with a number of reflectors.

7. A lighting device comprising:

a socket for holding a lamp, said socket having a resilient annular spring and at least one arm provided with a click;

a reflector for reflecting light from the lamp; and a back plate connected to the reflector so that said socket is held between the back plate and the reflector;

wherein the back plate includes at least one pressure point extending upwardly therefrom when in contact with the click of the socket, displaces the click in a direction of the reflector over a distance so as to put the annular spring under tension;

wherein the socket includes at least on electrically conducting female terminal, and the back plate includes at least one mating electrically conducting male terminal such that, when the back plate is moved towards the socket, the male terminal is inserted with friction into the female terminal so to hold the back plate and socket together and to position the at least one pressure point with respect to the click.

8. The lighting device of claim 7, wherein the distance is such that the annular spring presses the socket towards the reflector with a force of at least 5 N.

9. The lighting device of claim 7, wherein the click is displaced by the at least one pressure point over a distance ranging from 0.5 mm up to 2 mm.

10. The lighting device of claim 7, wherein the socket is formed as an integral part from a synthetic resin.

11. The lighting device of claim 7, wherein the back plate is made from an electrically insulating material and includes at least one printed circuit connected to the at least one male terminal.

12. A socket for holding a lamp, the socket comprising:

a resilient annular spring; and at least one arm provided with a click for contacting an upwardly extending pressure point of a back plate and being displaced in a direction away from the back plate over a distance so as to put the annular spring under tension;

wherein the distance is such that the annular spring presses the socket towards the reflector with a force of at least 5 N;

wherein the socket includes at least on electrically conducting female terminal, and the back plate includes at least one mating electrically conducting male terminal such that, when the back plate is moved towards the socket, the male terminal is inserted with friction into the female terminal so to hold the back plate and socket together and to position the at least one pressure point with respect to the click.

13. The socket of claim 12, wherein the click is displaced by the pressure point over a distance ranging from 0.5 mm up to 2 mm.

14. A back plate for receiving a socket that holds a lamp, the back plate comprising:

at least one pressure point extending upwardly from the back plate and when the at least on pressure point in contact with an arm provided with a click of the socket, displaces the click in a direction away from the back plate over a distance so as to put an annular spring of the socket under tension;

wherein the socket includes at least on electrically conducting female terminal, and the back plate includes at least one mating electrically conducting male terminal such that, when the back plate is moved towards the socket, the male terminal is inserted with friction into the female terminal so to hold the back plate and socket together and to position the at least one pressure point with respect to the click;

wherein the back plate is made from an electrically insulating material and includes at least one printed circuit connected to the at least one male terminal.

15. The back plate of claim 14, further comprising a fastener for fastening the back plate to a reflector.

* * * * *